US012196529B2

(12) United States Patent
Teetzel et al.

(10) Patent No.: US 12,196,529 B2
(45) Date of Patent: Jan. 14, 2025

(54) ACCESSORY CONTROL HANDGRIP APPARATUS FOR WEAPON

(71) Applicant: Wilcox Industries Corp., Newington, NH (US)

(72) Inventors: James W. Teetzel, Portsmouth, NH (US); Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 13 days.

(21) Appl. No.: 17/834,078

(22) Filed: Jun. 7, 2022

(65) Prior Publication Data

US 2022/0412695 A1 Dec. 29, 2022

Related U.S. Application Data

(60) Provisional application No. 63/214,613, filed on Jun. 24, 2021.

(51) Int. Cl.

| | |
|---|---|
| ***F41G 11/00*** | (2006.01) |
| ***F41C 23/16*** | (2006.01) |
| ***F41C 27/00*** | (2006.01) |
| ***F41G 1/35*** | (2006.01) |

(52) U.S. Cl.

CPC ..... *F41G 11/003* (2013.01); *F41C 23/16* (2013.01); *F41C 27/00* (2013.01); *F41G 1/35* (2013.01)

(58) Field of Classification Search

CPC ..... F41G 11/003; F41G 1/35; F41C 23/16; F41C 27/00

See application file for complete search history.

(56) References Cited

U.S. PATENT DOCUMENTS

| | | | | |
|---|---|---|---|---|
| 5,355,608 | A | 10/1994 | Teetzel | |
| 5,448,847 | A | 9/1995 | Teetzel | |
| 5,481,819 | A * | 1/1996 | Teetzel | F41A 19/58 42/117 |
| 5,522,167 | A | 6/1996 | Teetzel | |
| 5,555,662 | A | 9/1996 | Teetzel | |
| 5,570,528 | A | 11/1996 | Teetzel | |
| 5,669,174 | A | 9/1997 | Teetzel | |
| 5,685,105 | A * | 11/1997 | Teetzel | F41A 21/30 42/146 |
| 5,787,628 | A | 8/1998 | Teetzel | |
| 5,822,905 | A * | 10/1998 | Teetzel | F41G 1/36 42/117 |
| 6,230,431 | B1 * | 5/2001 | Bear | F41G 11/001 42/117 |

(Continued)

FOREIGN PATENT DOCUMENTS

| | | |
|---|---|---|
| EP | 4109033 B1 | 12/2022 |
| WO | 9641998 A2 | 12/1996 |

OTHER PUBLICATIONS

Extended European Search Report received in European patent application No. 22178572.8, dated Nov. 10, 2022.

*Primary Examiner* — Michelle Clement
(74) *Attorney, Agent, or Firm* — McLane Middleton, Professional Association

(57) ABSTRACT

An accessory control handgrip apparatus for weapon includes a rail clamp assembly, a grip base extending from the grip base assembly, a grip sleeve slidably received on the grip base, a keypad disposed on the grip sleeve, and one or more connectors for operably coupling the keypad to an accessory device.

16 Claims, 4 Drawing Sheets

(56) References Cited

U.S. PATENT DOCUMENTS 6,378,237 B1 * 4/2002 Matthews ..... H01H 3/20 42/146
6,568,118 B1 * 5/2003 Teetzel ..... F41G 1/48 42/105
7,199,315 B1 * 4/2007 Sharrah ..... F41G 1/34 200/61.43
7,243,454 B1 * 7/2007 Cahill ..... F41C 23/16 42/72
7,273,292 B2 * 9/2007 Kim ..... F41G 1/34 42/117
7,332,682 B2 * 2/2008 Kim ..... F41G 11/003 200/18
7,438,430 B2 * 10/2008 Kim ..... F41G 11/003 200/18
7,441,918 B2 * 10/2008 Kim ..... F41G 1/34 200/18
7,464,495 B2 * 12/2008 Cahill ..... F41C 23/12 42/72
7,568,304 B1 8/2009 Moody et al.
7,578,089 B1 * 8/2009 Griffin ..... F41C 23/22 42/72
7,676,975 B2 * 3/2010 Phillips ..... F41C 23/16 42/72
7,685,759 B2 3/2010 Teetzel
7,698,847 B2 * 4/2010 Griffin ..... F41G 1/35 42/72
7,712,241 B2 5/2010 Teetzel et al.
7,819,547 B1 10/2010 Teetzel et al.
7,841,120 B2 11/2010 Teetzel et al.
7,845,105 B1 * 12/2010 Cahill ..... F41C 27/00 42/117
7,866,083 B2 1/2011 Teetzel
8,091,265 B1 1/2012 Teetzel et al.
8,215,047 B2 * 7/2012 Ash, Jr. ..... F41C 23/14 42/71.01
8,220,946 B1 7/2012 Teetzel
8,297,173 B1 10/2012 Teetzel et al.
8,458,944 B2 * 6/2013 Houde-Walter ..... F41C 23/16 42/72
8,720,098 B2 * 5/2014 Burress, Jr. ..... F41C 23/10 42/71.01
8,752,321 B2 * 6/2014 Burress, Jr. ..... F41C 23/16 42/71.01
8,776,422 B2 * 7/2014 Dodd ..... F41G 11/003 42/72
8,800,194 B2 8/2014 Teetzel et al.
8,839,544 B2 * 9/2014 Troy ..... F41C 23/16 42/72
8,978,539 B2 3/2015 Teetzel et al.
9,228,804 B2 * 1/2016 Syrengelas ..... F41G 1/345
9,506,723 B2 11/2016 Teetzel et al.
9,752,853 B2 9/2017 Emire et al.
9,897,411 B2 * 2/2018 Compton ..... F41G 11/00
9,966,204 B2 * 5/2018 McCauley ..... F41G 11/003
9,991,062 B2 * 6/2018 Zimmer ..... H01H 9/0235
10,060,705 B2 * 8/2018 Compton ..... H04B 5/0031
10,082,363 B2 * 9/2018 Burgess ..... F41G 11/003
10,107,586 B2 * 10/2018 Derousse ..... F41C 23/12
10,197,358 B2 * 2/2019 Hebden ..... F41C 23/16
10,502,365 B2 * 12/2019 Moody ..... G03B 17/563
10,514,235 B1 * 12/2019 McCauley ..... H01H 9/02
10,527,387 B1 * 1/2020 Oliva Chavez ..... F41C 23/16
10,551,149 B2 2/2020 Teetzel et al.
10,557,687 B2 2/2020 Teetzel et al.
10,578,396 B2 3/2020 Lemire et al.
10,641,583 B2 * 5/2020 Zimmer ..... F41G 11/003
10,969,202 B2 4/2021 Teetzel et al.
11,035,646 B2 6/2021 Teetzel et al.
11,092,323 B2 * 8/2021 Hawk ..... F21V 23/0414
D931,233 S * 9/2021 Pan ..... D22/108
11,112,208 B1 * 9/2021 Mantas ..... F41C 23/16
11,118,859 B1 * 9/2021 Hawk ..... F21V 23/0485
11,175,114 B1 * 11/2021 Lee ..... F16L 3/02
11,514,775 B2 * 11/2022 Zimmer ..... H01R 33/955
11,607,795 B2 * 3/2023 Brauer ..... B25G 3/08
2005/0116815 A1 * 6/2005 Chen ..... F41G 1/35 340/331
2005/0188588 A1 * 9/2005 Keng ..... F41A 23/10 42/72
2005/0241206 A1 * 11/2005 Teetzel ..... F41A 23/08 42/72
2006/0191183 A1 * 8/2006 Griffin ..... F41C 23/16 42/72
2007/0235298 A1 * 10/2007 Kim ..... F41G 1/34 200/18
2008/0052979 A1 * 3/2008 Lee ..... F41A 23/08 42/73
2010/0242332 A1 9/2010 Teetzel et al.
2011/0261559 A1 * 10/2011 Couture ..... F21L 4/005 362/208
2014/0082984 A1 3/2014 Kent et al.
2015/0153130 A1 * 6/2015 Amis ..... A63F 13/837 434/21
2015/0264229 A1 9/2015 Teetzel et al.
2016/0245616 A1 * 8/2016 Derousse ..... F41C 23/16
2017/0303099 A1 10/2017 Teetzel et al.
2018/0053607 A1 * 2/2018 McCauley ..... F41G 11/003
2018/0321013 A1 11/2018 Teetzel et al.
2019/0376755 A1 12/2019 Teetzel et al.
2021/0108885 A1 * 4/2021 Derousse ..... F41C 23/16
2022/0221944 A1 * 7/2022 Patel ..... F41G 11/003

* cited by examiner

ACCESSORY CONTROL HANDGRIP APPARATUS FOR WEAPON

CROSS REFERENCE TO RELATED APPLICATION

This application claims the priority benefit of U.S. Provisional application No. 63/214,613 filed Jun. 24, 2021. The aforementioned application is incorporated herein by reference in its entirety.

BACKGROUND

The present disclosure relates to a combination weapon handgrip and weapon accessory controller. The apparatus disclosure herein is convertible between a single cable configuration for controlling a weapon mounted weapon accessory device and a dual cable configuration for controlling a weapon mounted weapon accessory device and a weapon mounted flashlight accessory device.

SUMMARY

In one aspect, an accessory control handgrip apparatus for weapon includes an elongate grip base having a longitudinal axis and a first engagement surface, the first engagement surface extending axially and facing radially outward. A fastener is connected to a proximal end of the grip base, the fastener for removably attaching the handgrip apparatus to a fore-end portion of a weapon. An elongate grip sleeve has an axially extending bore and the grip base is detachably received within the axially extending bore and is coaxial with the grip base. The axially extending bore has a second engagement surface which extends axially and which faces radially inward, wherein the second engagement surface slidably engages the first engagement surface. The elongate grip sleeve has a radially outward facing surface defining a hand-grip surface. At least one keypad comprising a switch is disposed on the handgrip surface, the switch for controlling operation of one or more electrically-operated devices associated with the weapon. A connector is electrically coupled to the switch and is configured to electrically couple the switch to the one or more electrically-operated devices.

In a more limited aspect, the first engagement surface is configured to engage the second engagement surface when the grip sleeve is oriented at a plurality of rotational positions with respect to the grip base.

In another more limited aspect, the first engagement surface and second engagement surface both have a cross-sectional shape which has an n-fold rotational symmetry about the longitudinal axis, wherein n is an integer greater than or equal to 2. In a further limited aspect, n is an integer between 2 and 16. In a still further limited aspect, n is equal to 8.

In another more limited aspect, the first engagement surface and second engagement surface both have a cross-sectional shape which has a 1-fold rotational symmetry about the longitudinal axis to provide a single aligned orientation between the grip base and the grip sleeve.

In another more limited aspect, the grip base forms a hollow enclosure which opens at a distal end of the grip base.

In another more limited aspect, the accessory control handgrip apparatus further includes an end cap removably attached to the distal end of the grip base. In a further more limited aspect, the end cap comprises internal helical threads complementary with external helical threads on the distal end of the grip base. In yet another more limited aspect, the end cap engages a distal end of the grip sleeve to secure the grip sleeve in a fixed axial position with respect to the grip base.

In another more limited aspect, the at least one keypad is detachable from the grip sleeve.

In another more limited aspect, the grip sleeve incudes an integral interface slidably receiving the at least one keypad.

In another more limited aspect, the at least one keypad comprises a first keypad and a second keypad, wherein the first and second keypads are interchangeably attachable to the grip sleeve.

In another more limited aspect, the accessory control handgrip apparatus further includes an electrically operated accessory device having a mode of operation actuatable or controllable by the switch, the electrically operated accessory device configured to be detachably secured to the weapon.

In another more limited aspect, the fastener is a weapon accessory rail clamp. In yet another more limited aspect, the fastener is adapted for removable attachment to a rail interface selected from a Picatinny rail interface.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENT(S)

Figure 1:
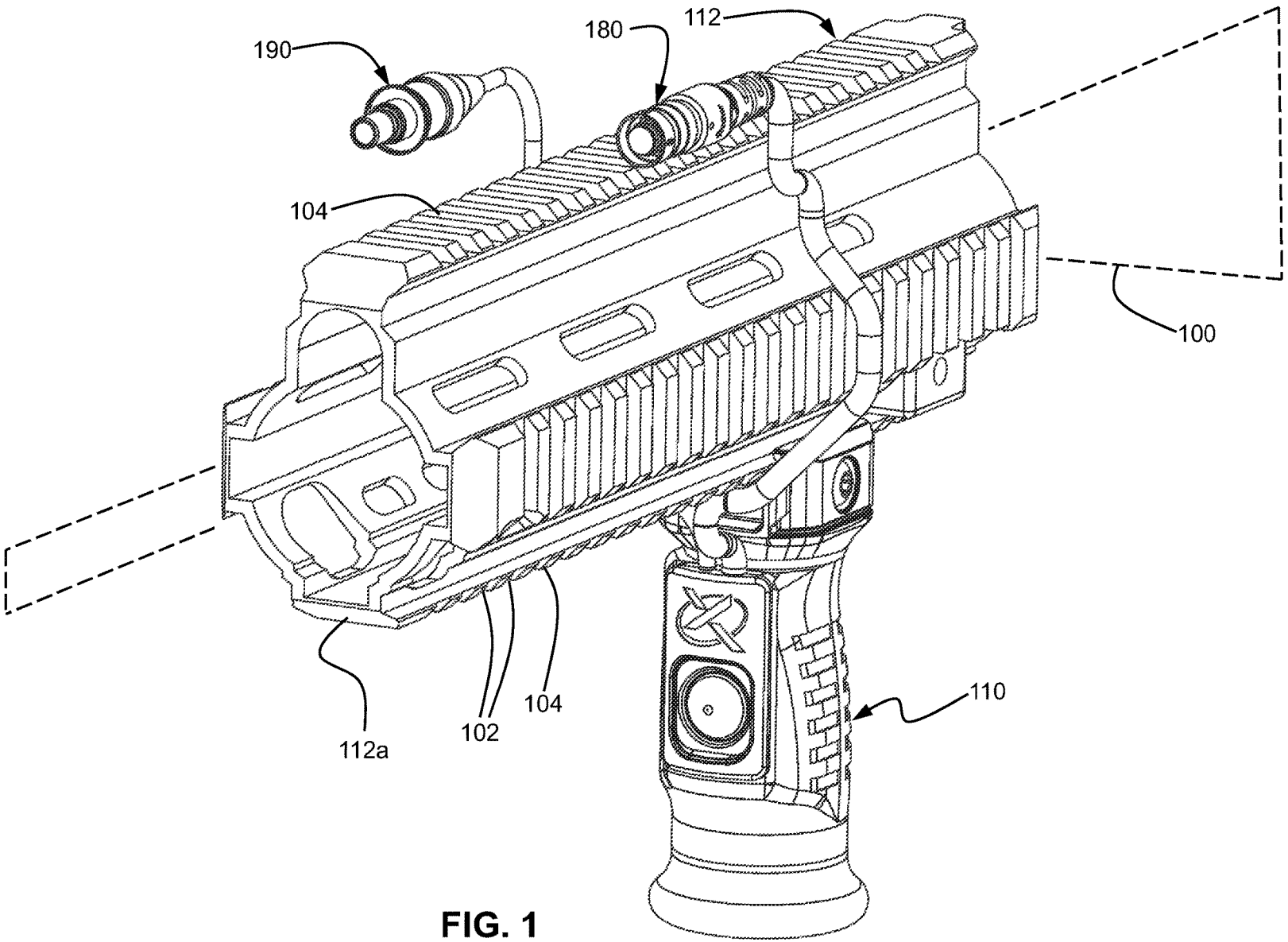
FIG. 1 is an isometric view of an exemplary embodiment of the handgrip apparatus herein attached to a weapon accessory rail.

Referring to the drawing figures FIGS. 1-4B, a control handgrip apparatus 110 is provided which may be mounted to an accessory rail interface assembly 112 of a weapon 100 (shown in phantom lines). The weapon may be a firearm such as a military or tactical rifle having a Picatinny rail interface. As used herein, the term Picatinny rail interface refers to a bracket used on some firearms in order to provide a standardized mounting platform. Typically, Picatinny rail interfaces have a beveled T-shaped cross-sectional shape and having a series of alternating transverse grooves 102 and flats 104. Exemplary Picatinny rail interfaces include MIL-STD-1913 rails or STANAG 2324 rails, which are well known by persons skilled in the art. Although the present embodiment is illustrated in connection with a bottom rail 112*a* of a quad-rail type Picatinny rail interface, it will be recognized that the present invention may be adapted for use with all manner of weapons, including without limitation rifles, handguns, machine guns, mortars, etc., and all manner of weapon accessory mount rail interfaces or mounting systems.

The terms "a" or "an," as used herein, are defined as one or more than one. The term "another," as used herein, is defined as at least a second or more. The terms "including" and/or "having" as used herein, are defined as "comprising"

(i.e., open transition). Unless specifically stated otherwise, the terms "attached," "coupled," "operatively coupled," "joined", and the like are defined as indirectly or directly connected.

In certain embodiments, the handgrip 110 is configured for use as a conventional vertical handgrip, which extends generally perpendicular to the rail interface, although it will be recognized that some amount of variation from perpendicular (e.g., up to about 5 degrees) is also contemplated.

The handgrip 110 includes an upper end defining a rail clamp assembly 114 which includes a fixed or integral clamp member 116 and a movable clamp member 118 on opposite transverse sides of the rail 112*a*.

Figure 2:
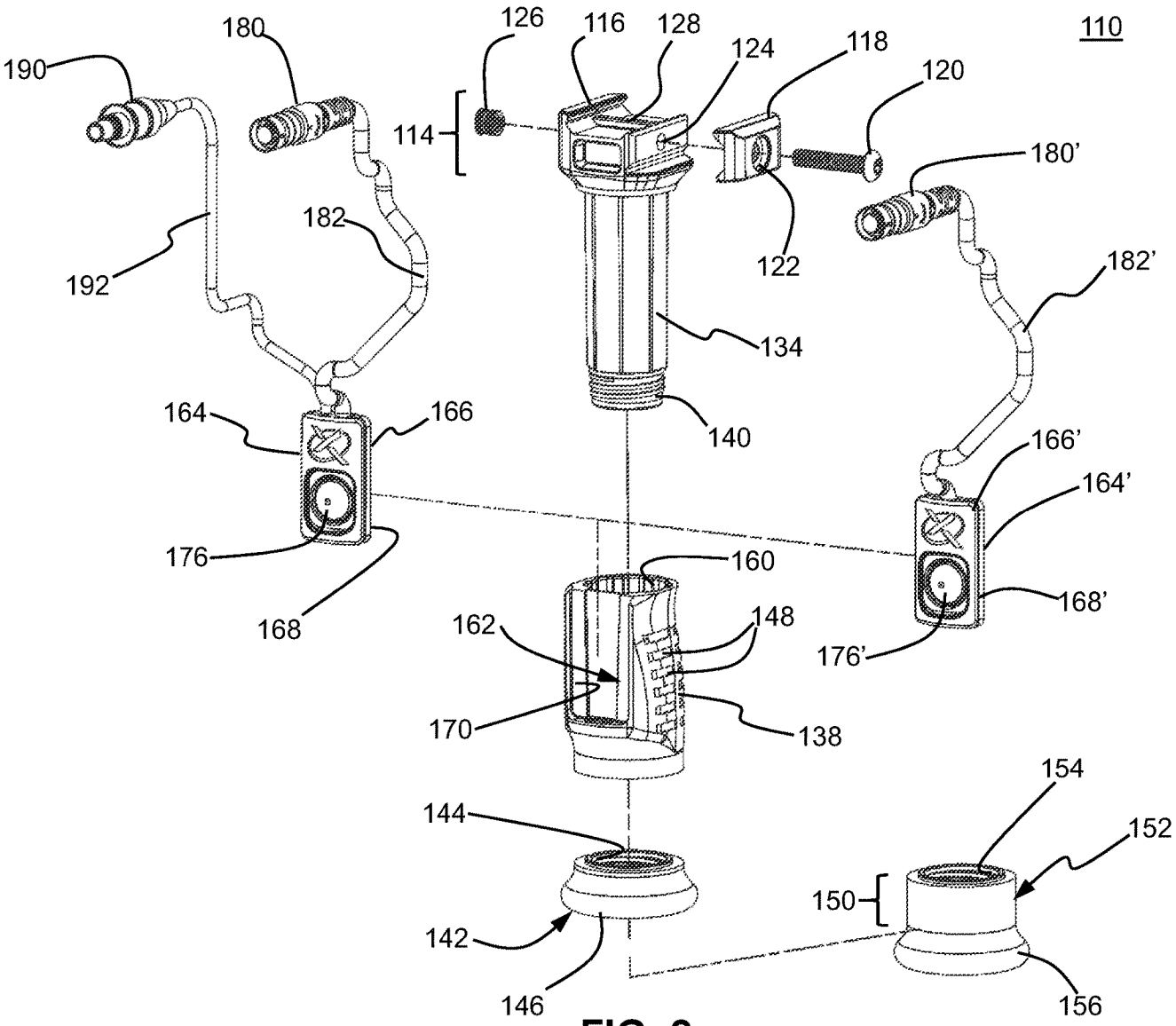
FIG. 2 is an exploded view of the handgrip apparatus herein appearing in FIG. 1.
Figure 3:
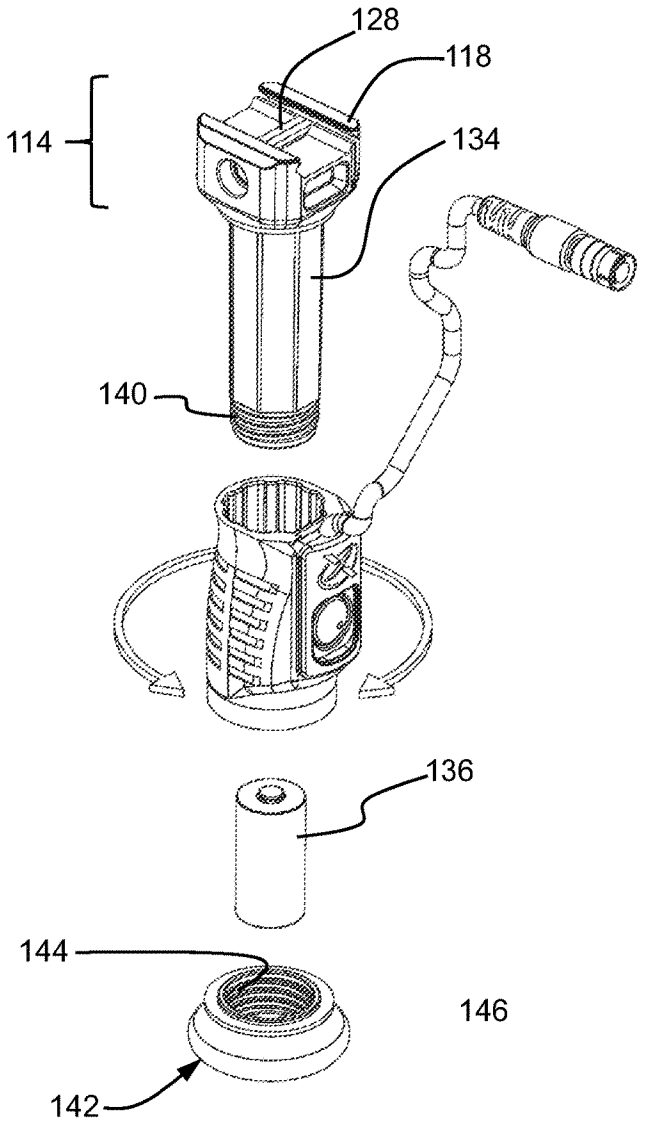
FIG. 3 is an enlarged, partially exploded view of the handgrip apparatus herein in a single cable configuration.
Figure 4B:
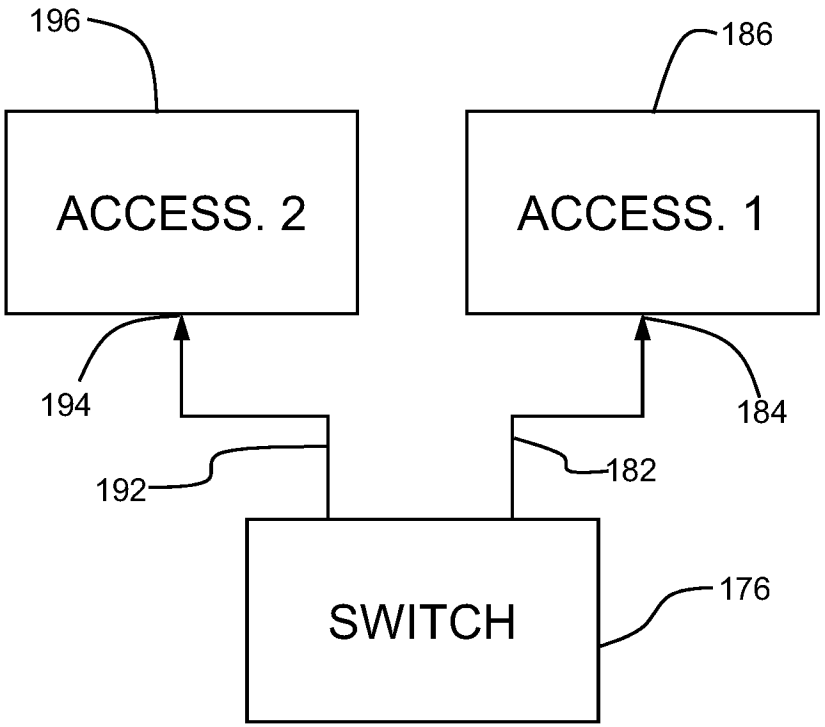
FIGS. 4A and 4B are schematic diagrams of a single cable embodiment and a double cable embodiment, respectively.
Figure 4A:
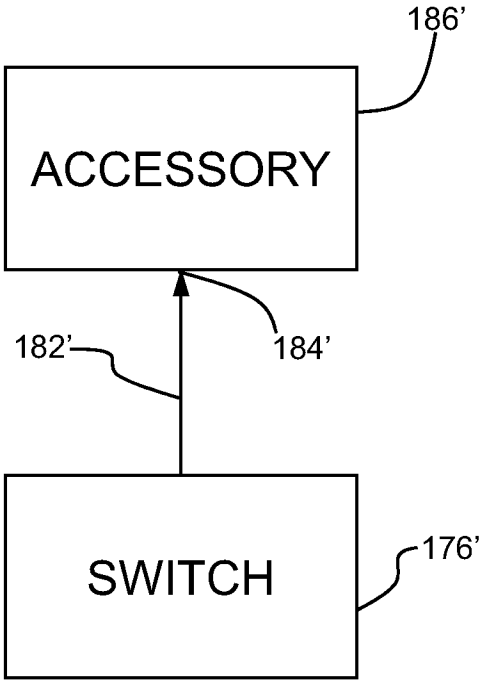

As best seen in FIG. 2, a threaded fastener 120 passes through an opening 122 in the clamp member 118 and an aligned opening 124 in the rail clamp assembly 114. The threaded fastener 120 engages an internally threaded nut insert 126 which is inset in the clamp member 116. The fastener 120 can be selectively tightened and loosened to engage and disengage, respectively, the rail member 112*a* and allows the hand grip unit 110 to be secured at a desired axial position along the rail 112*a*. A transverse recoil rib 128 rests within a selected one of the recoil grooves 102 on the accessory rail interface 112*a*. Although the nut 126 and fastener 120 are illustrated in FIG. 2 as being separated for ease of illustration, in optional embodiments, a protrusion (not shown) or other means may be provided on the end of the threaded fastener 120 for preventing complete removal of the threaded rod 120 from the nut 126.

An elongate grip base 134 extends downward, in the orientation shown, from the rail clamp assembly 114. The grip base 134 defines an interior compartment for receiving one or more spare batteries 136, e.g., a replacement battery for an accessory device such as the first accessory device and/or second accessory device. In certain embodiments, the one or more batteries 136 are selected from rechargeable and non-rechargeable batteries. Exemplary battery types include alkaline, lithium, lithium ion, lithium polymer, lithium manganese (IMR), CR123, CR123a, 14500, 18350, 18650, 26650, and others.

The grip base 134 and rail clamp assembly 114 may be formed of any suitable material, including metal or metal alloy, polymer, or composite materials. The rail clamp assembly may be formed via molding (e.g., injection molding), machining, or additive manufacturing methods.

A grip sleeve 138 is slidably received over the grip base 134. In certain embodiments, the grip sleeve 138 is formed of rubber, elastomeric polymer, or the like. The grip sleeve 138 may be shaped or contoured to accommodate a user's hand. The grip sleeve 138 may include grooves, ridges, knurls, or other handgrip features 148 to assist the user in gripping the handgrip 110.

The lower end of the grip base 134 has external threads 140. A first removable end cap 142 includes internal threads 144 which are complementary with the threads 140. The end cap 142 has a flared, flanged, or enlarged diameter base 146, e.g., to reduce slipping or prevent the user's hand from slipping when grasping the unit 110.

In certain embodiments, the first removable end cap 142 is interchangeable with a second removable end cap 152 which includes internal threads 154 which are complementary with the threads 140. The end cap 152 has a flared, flanged, or enlarged diameter base 156, e.g., to reduce slipping or prevent the user's hand from slipping when grasping the unit 110, and an axially extended portion 150 to increase the axial length of the hand grip 110. In this manner, the length of the grip 110 can be adjusted to accommodate different hand sizes.

The grip sleeve 138 includes an interface 162 for receiving an activation keypad. In certain embodiments, a plurality of interchangeable activation keypads is provided. In certain embodiments, a first interchangeable activation keypad 164 is provided for controlling two firearm or weapon accessory devices and a second interchangeable activation keypad 164' is provided for controlling one firearm or weapon accessory device. Other configurations are also contemplated, such as other activation keypads for controlling other numbers of devices or other cable configurations and/or connector types for adapting the unit to activate different types of accessory devices.

The activation keypad 164 has sliding interface features which engage the interface 162, e.g., a dovetail type interface, tongue and groove type interface, or the like. In certain embodiments, the keypad 164 includes a housing 166 having slide rails 168 on opposite sides thereof for engaging complementary grooves 170 in the interface 162.

The keypad 164 includes a switch 176, such as a mechanical contact switch. In certain embodiments, the switch 176 is a normally open, momentary contact switch, e.g., which is resiliently depressible to close the contacts for actuating an attached device. It will be recognized that other switch configurations are also contemplated.

The switch 176 is coupled to an accessory device interface 180 via a cable 182. The interface 180 engages a complementary interface 184 on a first associated accessory device 186. The switch 176 is also coupled to an accessory device interface 190 via a cable 192. The interface 190 engages a complementary interface 194 on a second associated accessory device 196. In preferred embodiments, the first accessory device 186 is a laser device, such as a laser pointer, aiming device, or target illumination device. In certain embodiments, the second accessory device 196 is a flashlight.

In certain embodiments, the interface 180 is configured to attach to a remote control port on the accessory device 186. In certain embodiments, the interface 190 is configured to attach in place of an end cap switch assembly on a flashlight. In certain embodiments, the switch 176 may be used to actuate the first and second accessory devices. In certain embodiments, the switch 176 may be used to select functions or otherwise control operation of the first and second accessory devices, e.g., through button presses of various lengths of time, e.g., quick press, medium press, long press, etc., button press sequences, e.g., single press, double press, triple press, etc., or combinations thereof.

In certain embodiments, the switch 176 is used to control operation of an attached flashlight by accessing functions such as on/off, brightness levels, wavelengths, modes, strobe functions, SOS functions, etc., by controlling the number or presses and/or hold time of a button press or button press sequence.

The second activation keypad 164' has sliding interface features which engage the interface 162, e.g., a dovetail type interface, tongue and groove type interface, or the like. In certain embodiments, the keypad 164' includes a housing 166' having slide rails 168' on opposite sides thereof for engaging the complementary grooves 170 in the interface 162.

The keypad 164' includes a switch 176' which may be as described above by way of reference to the switch 176. The switch 176' is electrically coupled to a connector 174' via a cable 172'.

The switch 176' is coupled to an accessory device interface 180' via a cable 182'. The interface 180' engages a complementary interface 184' on an associated accessory device 186'.

In certain embodiments, the interface 180' is configured to attach to a remote control port on the accessory device 186'. In certain embodiments, the switch 176' may be used to actuate the accessory device 186'. In certain embodiments, the switch 176' may be used to select functions or otherwise control operation of the accessory device 186', e.g., through button presses of various lengths of time, e.g., quick press, medium press, long press, etc., button press sequences, e.g., single press, double press, triple press, etc., or combinations thereof.

The grip sleeve 138 has an axially extending interior opening 160 which has a cross-sectional shape that is complementary with a cross sectional shape of the grip base 134. In certain embodiments, the cross-sectional shape of the opening 160 and complementary cross-sectional shape of the grip base portion 134 is a geometric shape that has an n-fold rotational symmetry about the center, wherein n is 2 or more, e.g., 2, 3, 4, 5, 6, 7, 8, 9, 10, 11, 12, 13, 14, 15, 16, or more. In this manner, the grip sleeve 138 can receive the grip base 134 so as to position the keypad 164 at a desired rotational position on the unit 110, e.g., to accommodate left and right handed users, as well as to accommodate personal preference with respect to keypad position.

In alternative embodiments, the cross-sectional shape of the opening 160 and grip base 134 has a 1-fold rotational symmetry about the center axis, e.g., a keyed geometry, to provide a single rotationally-aligned orientation between the grip base 134 and the grip sleeve 138.

In certain embodiments, the cross-sectional shape of the opening 160 and grip base 134 is a regular convex polygon. In certain embodiments, the cross-sectional shape of the opening 160 and grip base 134 is a regular concave polygon. In certain embodiments, the cross-sectional shape of the opening 160 and grip base 134 is a star polygon. In certain embodiments, the cross-sectional shape of the opening 160 and grip base 134 is a geometric shape having straight edges, curved edges, or a combination thereof. In certain embodiments, the interior surface of the opening 160 has a plurality of axially extending ribs or splines angularly spaced apart which are aligned and complementary with a corresponding number of grooves or channels on the grip base 134. In certain embodiments, the grip base 134 has a plurality of axially extending ribs or splines angularly spaced apart which are aligned and complementary with a corresponding number of grooves or channels formed on the interior surface of the opening 160.

The invention has been described with reference to the preferred embodiments. Modifications and alterations will occur to others upon a reading and understanding of the preceding disclosure herein, whereby it is to be distinctly understood that the foregoing descriptive matter is to be interpreted merely as illustrative of the invention and not as a limitation. Accordingly, the scope of the invention should be determined solely by the appended claims and their legal equivalents.

What is claimed is:

1. An accessory control handgrip apparatus for weapon, comprising:

an elongate grip base having a longitudinal axis and a first engagement surface, the first engagement surface extending axially and facing radially outward;

a fastener connected to a proximal end of the grip base, said fastener for removably attaching the handgrip apparatus to a fore-end portion of a weapon;

an elongate grip sleeve having an axially extending bore, the grip base detachably received within the axially extending bore and coaxial with the grip base, the axially extending bore having a second engagement surface, the second engagement surface extending axially and facing radially inward, the second engagement surface slidably engaging the first engagement surface, wherein the first engagement surface is configured to engage the second engagement surface when the grip sleeve is oriented at a plurality of rotational positions with respect to the grip base and wherein the first engagement surface and second engagement surface both have a cross-sectional shape which has an n-fold rotational symmetry about the longitudinal axis, wherein n is an integer greater than or equal to 2;

the elongate grip sleeve having a radially outward facing surface defining a handgrip surface;

at least one keypad comprising a switch disposed on the handgrip surface, the switch for controlling operation of one or more electrically-operated devices associated with the weapon; and a connector electrically coupled to the switch and configured to electrically couple the switch to the one or more electrically-operated devices.

2. The accessory control handgrip apparatus of claim 1, wherein n is an integer between 2 and 16.

3. The accessory control handgrip apparatus of claim 1, wherein n is equal to 8.

4. The accessory control handgrip apparatus of claim 1, wherein the grip base forms a hollow enclosure which opens at a distal end of the grip base.

5. The accessory control handgrip apparatus of claim 4, further comprising an end cap removably attached to the distal end of the grip base.

6. The accessory control handgrip apparatus of claim 5, wherein the end cap comprises internal helical threads complementary with external helical threads on the distal end of the grip base.

7. The accessory control handgrip apparatus of claim 5, wherein the end cap engages a distal end of the grip sleeve to secure the grip sleeve in a fixed axial position with respect to the grip base.

8. The accessory control handgrip apparatus of claim 5, further comprising an extended end cap detachably attachable to the distal end of the grip base in place of the end cap to increase an axial extent of a gripping surface of the hand grip apparatus.

9. The accessory control handgrip apparatus of claim 1, wherein the at least one keypad is detachable from the grip sleeve.

10. The accessory control handgrip apparatus of claim 9, wherein the grip sleeve includes an integral interface slidably receiving the at least one keypad.

11. The accessory control handgrip apparatus of claim 9, wherein the at least one keypad comprises a first keypad and a second keypad, wherein the first and second keypads are interchangeably attachable to the grip sleeve.

12. The accessory control handgrip apparatus of claim 1, further comprising an electrically operated accessory device having a mode of operation actuatable or controllable by the switch, the electrically operated accessory device configured to be detachably secured to the weapon.

13. The accessory control handgrip apparatus of claim 1, wherein the fastener is a weapon accessory rail clamp.

14. The accessory control handgrip apparatus of claim 13, wherein the fastener is adapted for removable attachment to a rail interface selected from a Picatinny rail interface.

15. The accessory control handgrip apparatus of claim 10, wherein the integral interface comprises a pair of opposing axially extending grooves configured to slidably receive a pair of slide rails disposed on the keypad.

16. An accessory control handgrip apparatus for weapon, comprising:

an elongate grip base having a longitudinal axis and a first engagement surface, the first engagement surface extending axially and facing radially outward;

a fastener connected to a proximal end of the grip base, said fastener for removably attaching the handgrip apparatus to a fore-end portion of a weapon;

an elongate grip sleeve having an axially extending bore, the grip base detachably received within the axially extending bore and coaxial with the grip base, the axially extending bore having a second engagement surface, the second engagement surface extending axially and facing radially inward, the second engagement surface slidably engaging the first engagement surface, wherein the first engagement surface and second engagement surface both have a cross-sectional shape which has a 1-fold rotational symmetry about the longitudinal axis to provide a single aligned orientation between the grip base and the grip sleeve;

the elongate grip sleeve having a radially outward facing surface defining a handgrip surface;

at least one keypad comprising a switch disposed on the handgrip surface, the switch for controlling operation of one or more electrically-operated devices associated with the weapon; and a connector electrically coupled to the switch and configured to electrically couple the switch to the one or more electrically-operated devices.

* * * * *